US007424262B2

(12) United States Patent
Van Bortel et al.

(10) Patent No.: US 7,424,262 B2
(45) Date of Patent: Sep. 9, 2008

(54) SURFACE TREATMENT OF COATED MEDIA

(75) Inventors: David P. Van Bortel, Victor, NY (US); Jyothsna Ram, Rochester, NY (US); Alan Richard Kuntz, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 242 days.

(21) Appl. No.: 11/537,113

(22) Filed: Sep. 29, 2006

(65) Prior Publication Data

US 2008/0080913 A1 Apr. 3, 2008

(51) Int. Cl.
*G03G 15/20* (2006.01)

(52) U.S. Cl. ..... 399/341; 399/342; 399/407

(58) Field of Classification Search ..... 399/320, 399/340, 341, 342, 390, 407
See application file for complete search history.

(56) References Cited

U.S. PATENT DOCUMENTS

| | | | | |
|---|---|---|---|---|
| 5,353,108 | A * | 10/1994 | Tsukamoto | 399/390 |
| 6,032,004 | A | 2/2000 | Mirabella, Jr. et al. | |
| 6,743,561 | B2 | 6/2004 | Heeks et al. | |
| 6,782,144 | B2 | 8/2004 | Bellavita et al. | |
| 6,928,183 | B2 | 8/2005 | Mitchell et al. | |
| 6,950,615 | B2 * | 9/2005 | Jung et al. | 399/67 |
| 2004/0137203 | A1 | 7/2004 | Adams et al. | |
| 2005/0285918 | A1 | 12/2005 | McElligott et al. | |

* cited by examiner

*Primary Examiner*—Hoan H Tran
(74) *Attorney, Agent, or Firm*—Pepper Hamilton LLP

(57) ABSTRACT

A cleaning agent having one or more active ingredient which may remove residual release agents from printed material and methods for using the cleaning agents are described herein.

19 Claims, 1 Drawing Sheet

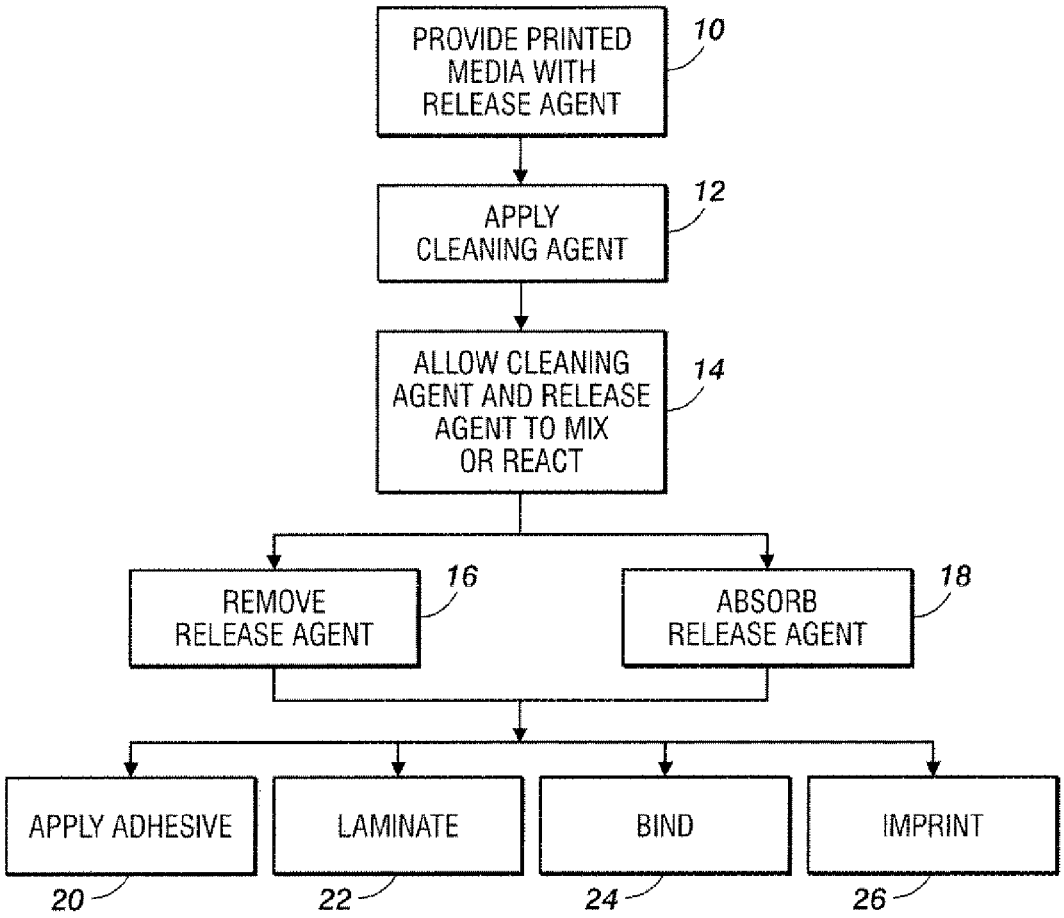
PROVIDE PRINTED MEDIA WITH RELEASE AGENT
10
APPLY CLEANING AGENT
12
ALLOW CLEANING AGENT AND RELEASE AGENT TO MIX OR REACT
14
REMOVE RELEASE AGENT
16
ABSORB RELEASE AGENT
18
APPLY ADHESIVE
20
LAMINATE
22
BIND
24
IMPRINT
26

SURFACE TREATMENT OF COATED MEDIA

RELATED APPLICATIONS

This application is related to co-pending U.S. patent application Ser. No. 11/424,243, filed Jun. 15, 2006, titled "Pre-Processing Cleaning of Pre-Printed Documents," the disclosure of which is incorporated herein by reference in its entirety.

BACKGROUND

1. Technical Field

This invention relates to surface treatments of printed media to improve adhesion of laminates and binding adhesives to improve the performance of finishing operations.

2. Description of the Related Art

In an electrostatographic process, a system is used whereby a uniform electrostatic charge is placed upon a reusable photoconductive surface. The charged photoconductive surface is then exposed to a light image of an original and the charge is selectively dissipated to form a latent electrostatic image of the original on the photoreceptor. The latent image is developed by depositing toner, finely divided marking and charged particles, on the photoreceptor surface. Toner becomes electrostatically attached to charged areas of the latent electrostatic image creating a toned developed image that is then transferred from the photoreceptor to a final image support material, such as, for example, paper. The toner is than fixed or fused to the image support material by a process of fusing.

During fusing, heat and pressure may be applied to the toned developed image to cause the thermal fusing of toner particles onto a support material. Pressure may be applied through several methods known in the art that generally include the passage of the toned developed image through a nip formed between a roll pair, plates, and/or belt members maintained in pressure contact. Heat may be concurrently applied to the toned developed image with the application of pressure in the nip, allowing the fusion of the toner image to the support media. The time required for the toner to become fused to the support material, or contact time, may vary depending on image, the type of support material, and the type of toner applied. Balancing the pressure, heat, and contact time may he an important aspect of the fusing process, and these parameters may be adjusted to suit particular machines, process conditions, and printing substrates.

Following the fusion process, the image support material must be released from the fuser, and the fuser must be cleaned of residual toner. This may be accomplished by mechanical means or by coating the surface of the fuser member with a polymer coating and, in some cases, one or more release agent to prevent the toner and/or support material from becoming inappropriately attached to the fuser member. Polymer coatings for a fuser member are well known in the art and include, for example, silicone rubber, fluoropolymers or fluoroelastomers such as polytetrafluoroethylene (PTFE), perfluoroalkoxy (PFA-TEFLON™), fluorinated ethylenepropylene copolymer (FEP), polyvinyl fluoride (PVF), and the like and mixtures thereof. On top of this polymer coating, a thin film of one or more release agents may be applied to a fuser member. Release agents are well known in the art and may generally be described as having a polymer backbone that may sterically block contact of the toner with the fuser surface with functional groups attached to the polymer backbone that may bind the release agent to the polymer coating of the fuser member and/or block contact of the toner with the fuser member surface. Common release agents may include, for example, polyorgano-siloxanes, modified polyorgano-siloxanes, polyorgano-siloxane oils and the like, and the use of these polymers to form a thermally stable, renewable self-cleaning layer having good release properties for many toners has been described, for example, in U.S. Pat. No. 4,029,827. Common functional groups useful in release agents include, but are not limited to, mercapto, amino, carboxy, hydroxy, epoxy, isocyanate, thioether, or combinations thereof, and the linkage formed between these groups and the polymer coating of the fuser member may be ionic or covalent in nature. Release agents are described in U.S. Pat. Nos. 4,029,827; 4,101,686; 4,185,140; 5,157,445; 5,395,725; 5,512,409; 5,516,361; 5,531,813; 5,698,320; 5,716,747; 5,747,212; and 6,183,929.

In many fusing applications, adequate coverage of the fuser member surface with a release agent is required to meet the demanding environmental conditions of the printing machine. For example, the release agent must withstand exposure to toner materials and additives, rapid thermal cycling, support media of various compositions and weights, various types of printing, and the like. Therefore, it may be necessary to utilize a release agent that robustly binds to the fuser member under these working conditions and/or to continually reapply the release agent to the fuser member to prevent release agent failure rendering the image quality poor or the fuser member unusable. In either case, the cost for operating the printing machine is dramatically increased.

The characteristics of release agent failure are well known in the art and include, but are not limited to "stripping failure," defined as a failure of the support medium leaving the exit nip to release from the surface of the fuser resulting in the support medium following the fuser through another cycle jamming the fuser member; "offset" characterized as the gradual build-up of un-transferred or unreleased residual toner on the fuser member allowing toner to be transferred onto the support media in subsequent copying cycles leading to increased background and/or the build-up of release agent on the fuser over the lifetime of the fuser member or other parts of the machine causing interference of the copying process and/or noticeable print quality defects; and "shot offset," which occurs when the temperature of the toner is raised to a point where the toner particles liquefy, and a portion of molten toner remains on the fuser member. Release properties may be determined by the hot offset temperature since as the temperature nears the hot offset temperature, the likelihood of toner offset occurring increases; and "wavy gloss" characterized as variation of the gloss level within a single imaged sheet caused by a build-up of release agent on the fuser member.

Coupled with the need for release agents that are durable and provide sufficient wetting of the fuser member, it is also important that the release agent have little or no interaction with support material. Unfortunately, residual release agent often remains on the printed support materials and can interfere with the binding of adhesives, laminates, or other binding materials and/or further processing of the printed material, such as, for example, imprinting. Accordingly, we have determined that materials and methods are required that may remove some or all of the residual release agent from the printed material without disturbing the fused toner image.

SUMMARY

In an embodiment, a method for removing a release agent from printed material includes applying a cleaning agent to a surface of a printed material that is at least partially coated with a release agent. The cleaning agent is allowed to rest on the surface for a period of time so that the cleaning agent chemically modifies the release agent. At least a portion of the release agent is removed from the surface of the printed material during the process. The removing may include absorbing the release agent into the printed material and/or washing the release agent from the printed material. Optionally, the applying may include automatically applying the cleaning agent to the printed material after the printed material exits a fuser in a printing process. The method also may include, following removing the release agent from the printed material, applying an adhesive to the printed material, laminating the printed material, binding the printed material, or imprinting the printed material.

The cleaning agent may include a surfactant, an acid, an organic solvent, a chelating agent, a transition metal or a transition metal salt. In embodiments where the cleaning agent comprises a surfactant, the surfactant may be from about 0.5% to about 5% by weight of the cleaning agent. In embodiments where the cleaning agent comprises an acid, the acid may be from about 1% to about 15% by weight of the cleaning agent, and the acid may comprise a lower aliphatic monocarboxylic acid, lower aliphatic dicarboxylic acid, citric acid, boric acid, carbonic acid, chloric acid, hydrochloric acid, nitric acid, sulfuric acid, perchloric acid, hydrofluoric acid, phosphoric acid, acetic acid, oxalic acid, hydroxyacetic acid, or a combination thereof. In embodiments where the cleaning agent comprises an organic solvent, the solvent may be up to 99.5% by volume of the cleaning agent, and the solvent may comprise saturated and unsaturated aliphatic and aromatic hydrocarbons, isobutene, toluenes, cyclohexanes, ketones, acetone, N-butyl acetate, methyl ethyl ketone, alcohols, ethanol, methanol, isopropanol, ethers, ethyl ether, halogenated hydrocarbons, trichloroethylene, perchloroethylene, phosphates, trisodium phosphate (TSP), mineral spirits, or combinations thereof. In embodiments where the cleaning agent comprises a chelating agent, the chelating agent is from about 1% to about 50% by weight of the cleaning agent, and the chelating agent is selected from the group consisting of ethylenediaminetetraacetic acid (EDTA), sodium citrate, dimethylsulfoxide (DMS), methylglycine diacetic acid (MGDA), zeolite compounds and combinations thereof. In some embodiments, the cleaning agent may include from 0.1% to about 25% by weight of zinc, nickel, copper, boron, chromium, a salt of any of the foregoing or a combination thereof, optionally in powdered form. Optionally, the cleaning agent also may include one or more auxiliary components such as anti-foaming agents, wetting agents, preservatives, colorants, and anti-microbial agents.

In an alternate embodiment, a method for removing one or more release agents from printed material includes applying a cleaning agent having one or more active ingredients selected from the group consisting of at least one surfactant, at least one acid, at least one organic solvent, at least one chelating agent, and at least one transition metal to a portion of a surface of a printed material. The surface contains a release agent. The method also includes removing at least a portion of the release agent from the surface, such as by absorbing the release agent into the printed material or allowing the cleaning agent to chemically modify the release agent. Optionally, the cleaning agent may be applied using mechanical pressure, and it may be in a state such as a solid, a liquid, a dispersion, or an aerosol. In addition, the applying may include wiping, spraying, dabbing, brushing, or dusting the printed material with the release agent. Optionally, after the removing, the method may include applying an adhesive to an area of the printed material, laminating an area of the printed material, binding an area of the printed material, or imprinting an area of the printed material. When such an option is employed, the portion to which the cleaning agent is applied may comprise the area that is adhered, laminated, bound or imprinted.

BRIEF DESCRIPTION OF THE DRAWINGS

FIG. 1 is a flow diagram that illustrates an exemplary method of treating a printed medium.

DETAILED DESCRIPTION

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope. For example, as used herein and in the appended claims, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

Embodiments presented herein may generally be directed to a cleaning agent that may be applied to printed materials to remove residual release agent on printed media prior to the application of adhesives as in a binding process, lamination of the printed material, and/or imprinting the printed material with, for example, metallic leaf MICR encoding, and the like. Without wishing to be bound by theory, the removal of residual release agents from printed material may allow adhesives, laminates, and imprinted material to bind to the printed material more readily thereby improving the quality of the final product.

The cleaning agents, of embodiments, may include at least one solvent, such as water or an organic solvent, and may contain one or more active ingredient broadly defined as surfactants, organic solvents, chelating agents, organic acids and inorganic acids, and transition metals or transition metal salts. Without wishing to be bound by theory, the active ingredients in the cleaning agent may cleave the polymer backbone of release agents freeing the release agent from the printed material, and the solvent may dilute the cleaved release agent allowing it to be washed away from or absorbed into the surface of the printed material. In some embodiments, a surfactant may be provided with the cleaning agent which may interact with the cleaved release agent inhibiting the rebinding of the release agent to the surface of the printed material or sequestering the cleaved particles of release agent allowing them to be more effectively washed away.

The concentration of active ingredients may vary among embodiments depending upon the type of toner, the type of support media, the final product, or combinations of these used in the printed material. In general, the concentration of the active agent may be determined such that the residual release agent is removed without disrupting the printed material by causing, for example, smearing, removal, or loss of color of the fused toner image. It is well within the prevue of the skilled artisan to determine the concentration of the one or more active agent that is most useful and to the dilute or concentrate the cleaning agent accordingly. For example, the cleaning agents of embodiments may be diluted by about 1:2 to 1:25 with water or solvent to accommodate various toner compositions.

Surfactants that may be used in embodiments are well known in the art and may commonly be referred to as soaps or detergents. Generally, a surfactant may include a molecule having a hydrophobic and hydrophilic part that is capable of emulsifying particles and keeping them suspended in solution, so that they may be washed away. Surfactants may be categorized based on their charge and include: anionic surfactants such as, for example, linear alkylbenzene sulfonate, alcohol ethoxysulfates, alkyl sulfates, lautyl sulfate, sodium xylene, sulfonate toluene, sulfonic acid and salts thereof sulfosuccinate salts, phosphonate esters, fatty acids and salts thereof, alkylpolyglucosides, soaps and the like; nonionic surfactants such as, for example, alcohol ethoxylates and the like, cationic surfactants including, but not limited to, quaternary ammonium compounds; and amphoteric surfactants whose charge is dependent on the pH of the cleaning agent such as, for example, midazolines, betaines and the like, all of which may be used in embodiments. The concentration of surfactant may vary in embodiments, and may from about 0.5% to about 10% by weight of the total cleaning agent in some embodiments and from 3% to 7% in other embodiments.

Organic solvents may act, in embodiments, by attacking amines within the polymer backbone of release agents thereby cleaving the backbone and carrying the cleaved release agent away from the surface of the printed materials. Organic solvents are well known in the art and commonly used in cleaning products. Non-limiting examples of organic solvents include, aliphatic and aromatic hydrocarbons which may be saturated or unsaturated, such as, isobutene, toluenes, cyclohexanes and the like; ketones, such as, acetone, N-butyl acetate, methyl ethyl ketone, and the like; alcohols, such as, ethanol, methanol, isopropanol, and the like; ethers, such as, ethyl ether and the like; halogenated hydrocarbons, such as, trichloroethylene, perchloroethylene and the like; phosphates, such as, trisodium phosphate (TSP), and the like; mineral spirits, and combinations thereof In some embodiments, other active ingredients, such as, for example, a chelating agent may be dissolved within organic solvent to enhance the effectiveness of the cleaning agent. The concentration of the organic solvent in a cleaning agent may be up to 100% by volume, in embodiments, and up to 99.5% in other embodiments.

One or more chelating agents may be an active ingredient in a cleaning solution of some embodiments, and in certain embodiments, one or more chelating agents may be used in combination with at least one surfactant. Chelating agents may, generally, be described as compounds that are capable of binding to metal ions. In embodiments, the chelating agent may bind directly to metal ions in release agents causing a breakdown of the release agent and/or effectively removing the release agent from the surface of the printed material. In other embodiments, the chelating agent may bind metal ions in the cleaning agent or on the printed material that may interfere with the action of the at least one surfactant. Therefore, the combination of a chelating agent and a surfactant may be especially effective for removing residual release agent. Chelating agents are well known in the art and include, but are not limited to, ethylenediaminetetraacetic acid (EDTA), sodium citrate, dimethylsulfoxide (DMSO), methylglycine diacetic acid (MGDA), zeolite compounds, and combinations of these and may be from about 1% to about 50% by weight of the total cleaning agent. However, there may be no upper limit to the concentration of chelating agent used in embodiments. In embodiments including the combination of one or more chelating agent and at least one surfactant, the chelating agent may be from about 1% to about 50% and the surfactant may be from about 0.5% to about 10% by weight of the total cleaning agent.

In embodiments, the cleaning agent may contain an organic or inorganic acid which may effectively disrupt the residual release agent without disturbing the fused toner of the printed material. Inorganic acids are well known in the art and include, but are not limited to, boric acid, carbonic acid, chloric acid, hydrochloric acid, nitric acid, sulfuric acid, perchloric acid, hydrofluoric acid, phosphoric acid, pyrophosphoric acid, and combinations thereof. Organic acids useful in embodiments may include those organic acids known in the art to be useful in cleaning agents, such as, aliphatic inonocarboxylic acids, aliphatic dicarboxylic acids, citric acid, acetic acid, oxalic acid, hydroxyacetic acid, benzoic acid, propinoic acid, and the like and combinations thereof Acids of embodiments may be dissolved in water to create an aqueous solution or in an organic solvent, and the acid may make up from about 1% to about 15% by weight of the total solution. The pH of the cleaning agent in which the acid solution is used may be from about 1 to about 5.

In other embodiments, the cleaning agent may contain a transition metal or transition metal salt. Transition metals that may be useful in embodiments include but are not limited to zinc, nickel, copper, boron, chromium, and the like and salts and combinations thereof In some embodiments, the transition metal or transition metal salt may be dissolved in water or an organic solvent to make a cleaning agent that is then applied to the printed material. In other embodiments, a transition metal salt, such as, for example, zinc stearate, may be applied directly to the printed material as a powder. The concentration of the transition metal or transition metal salt in cleaning agents of embodiments may be from about 0.1% to about 25% by weight when the transition metal or transition metal salt is dissolved in a solution or may be up to 100% in a powder.

Cleaning agents of embodiments may further contain one or more auxiliary component, such as, for example; antifoaming, wetting agents, preservatives; colorants; antimicrobial agents, and the like, all of which are well known in the art and available to the skilled artisan.

Referring to FIG. 1, the methods described herein may include providing a printed medium containing a release agent on a printed surface 10. The cleaning agents of embodiments may be applied 12 to the printed media by-hand or automatically, and in some embodiments, the cleaning agent may be applied automatically or by-hand. For example, the cleaning agent may be applied by-hand using a spray, cloth, brush, or towelette, and in certain embodiments, the cloth, brush, or towelette may be pre-moistened by soaking the cloth, brush, or towelette in the cleaning agent prior to use. In other embodiments, the cleaning agent may be applied to the printed media as a spray and removed by dabbing or wiping using a cloth, brush, or towelette.

In some embodiments, the cleaning agent may be applied to the printed media and allowed to mix or react 14 with the release agent for an amount of time that is sufficient to physically break down the chemical structure of the release agent. For example, the cleaning agent may be permitted to rest on the media for a time sufficient to allow the media to become dry to the touch, such as by absorption and/or evaporation of the cleaning agent. In some embodiments, if absorption of release agent into the media causes the media to slightly deform, the cleaning agent will be permitted to rest on the media for a time sufficient to allow the deformation to substantially release so that the product appears un-deformed. Smaller segments of the release agent may then be removed 16 with the cleaning agent, such as by washing which may include rinsing or simply allowing the cleaning agent to evaporate or flow off of the printed media, or the release agent may absorb 18 into the substrate of the printed material.

In embodiments including the automatic application of the cleaning agent, an apparatus may be designed that applies the cleaning agent to the printed material after the printed material exits the fuser using a web or brush. The apparatus may be an integral part of the electrostatographic or xerographic machine or may be a stand alone apparatus into which the printed material is placed following the printing process, and in some embodiments, may be added onto a preexisting electrostatographic or xerographic machine so that the printed material is automatically fed into the apparatus following fusing.

In both by-hand and automatic embodiments, mechanical pressure may be applied to the printed material as the cleaning agent is applied. In most embodiments, the mechanical pressure may be light and applied in such a way so as not to disturb the fused toner on the printed image. In other embodiments, the cleaning agent may be applied to the entirety of the printed material. In certain embodiments, such as embodiments where the printed material will receive an adhesive 20, be laminated 22, be bound 24, or be further imprinted 26, the cleaning agent may be applied to the part of the printed material to which adhesive, laminate, or imprinting is to be placed. In some embodiments, the cleaning agent may be applied to substantially only the part or parts of the printed material to which adhesive, laminate, or imprinting is to be placed, so that other portions of the printed material are not substantially contacted by the cleaning agent. For example, the cleaning agent may be applied to the edge of the printed material to which adhesive will be placed during binding, or the portion of the printed material to which a MICR imprint will be placed may be cleaned.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for removing a release agent from printed material comprising:

applying a cleaning agent to a surface of a printed material wherein the printed material is at least partially coated with a release agent;

allowing the cleaning agent to rest on the surface for a period of time during which time the cleaning agent chemically modifies the release agent; and removing at least a portion of the release agent from the surface of the printed material.

2. The method of claim 1, wherein the removing comprises:

absorbing the release agent into the printed material; or washing the release agent from the printed material.

3. The method of claim 1, wherein the cleaning agent comprises a surfactant, an acid, an organic solvent, a chelating agent, a transition metal or a transition metal salt.

4. The method of claim 3, wherein the cleaning agent comprises a surfactant, and the surfactant is from about 0.5% to about 5% by weight of the cleaning agent.

5. The method of claim 2, wherein the cleaning agent comprises an acid, the acid is from about 1% to about 15% by weight of the cleaning agent, and the acid comprises a lower aliphatic monocarboxylic acid, lower aliphatic dicarboxylic acid, citric acid, boric acid, carbonic acid, chloric acid, hydrochloric acid, nitric acid, sulfuric acid, perchloric acid, hydrofluoric acid, phosphoric acid, acetic acid, oxalic acid, hydroxyacetic acid, or a combination thereof.

6. The method of claim 3, wherein the cleaning agent comprises an organic solvent, the solvent is up to 99.5% by volume of the cleaning agent, and the solvent comprises saturated and unsaturated aliphatic and aromatic hydrocarbons, isobutene, toluenes, cyclohexanes, ketones, acetone, N-butyl acetate, methyl ethyl ketone, alcohols, ethanol, methanol, isopropanol, ethers, ethyl ether, halogenated hydrocarbons, trichloroethylene, perchloroethylene, phosphates, trisodium phosphate (TSP), mineral spirits, or combinations thereof.

7. The method of claim 3, wherein the cleaning agent comprises a chelating agent, the chelating agent is from about 1% to about 50% by weight of the cleaning agent, and the chelating agent is selected from the group consisting of ethylenediaminetetraacetic acid (EDTA), sodium citrate, dimethylsulfoxide (DMS), methylglycine diacetic acid (MGDA), zeolite compounds and combinations thereof.

8. The method of claim 3, wherein the cleaning agent comprises from 0.1% to about 25% by weight of zinc, nickel, copper, boron, chromium, a salt of any of the foregoing or a combination thereof.

9. The cleaning agent of claim 3, wherein the cleaning agent comprises a transition metal or transition metal salt in powdered form.

10. The method of claim 3, wherein the cleaning agent further comprises one or more auxiliary components selected from the group consisting of anti-foaming agents, wetting agents, preservatives, colorants, and anti-microbial agents.

11. The method of claim 10, wherein the applying comprises automatically applying the cleaning agent to the printed material after the printed material exits a fuser in a printing process.

12. The method of claim 1, further comprising following removing the release agent from the printed material, applying an adhesive to the printed material, laminating the printed material, binding the printed material, or imprinting the printed material.

13. A method for removing one or more release agents from printed material comprising:

applying a cleaning agent having one or more active ingredients selected from the group consisting of at least one surfactant, at least one acid, at least one organic solvent, at least one chelating agent, and at least one transition metal to a portion of a surface of a printed material, wherein the surface contains a release agent; and removing at least a portion of the release agent from the surface.

14. The method of claim 13, wherein the removing comprises absorbing the release agent into the printed material.

15. The method of claim 13, wherein the applying comprises allowing the cleaning agent to chemically modify the release agent.

16. The method of claim 15, wherein the applying the cleaning agent further comprises applying mechanical pressure to the printed material.

17. The method of claim 13, further comprising, after the removing:

applying an adhesive to an area of the printed material, laminating an area of the printed material, binding an area of the printed material, or imprinting an area of the printed material;

wherein the portion to which the cleaning agent is applied comprises the area that is adhered, laminated, bound or imprinted.

18. The method of claim 13, wherein the cleaning agent is in a state selected from the group consisting of a solid, a liquid, a dispersion, and an aerosol.

19. The method of claim 13, wherein the applying comprises wiping, spraying, dabbing, brushing, or dusting the printed material with the release agent.

* * * * *